US006450239B1

(12) United States Patent
von Sroka et al.

(10) Patent No.: US 6,450,239 B1
(45) Date of Patent: Sep. 17, 2002

(54) METHOD FOR OPERATING A HORIZONTAL STRIP CASTING FACILITY AND APPARATUS FOR CARRYING OUT THE METHOD

(75) Inventors: Anwar von Sroka, Kettenkamp; Hartmut Oelmann, Osnabrück, both of (DE)

(73) Assignee: KM Europa Metal AG, Osnabruck (DE)

( * ) Notice: Subject to any disclaimer, the term of this patent is extended or adjusted under 35 U.S.C. 154(b) by 0 days.

(21) Appl. No.: 09/392,681

(22) Filed: Sep. 9, 1999

(30) Foreign Application Priority Data

Sep. 9, 1998 (DE) ..... 198 41 116

(51) Int. Cl.[7] ..... B22D 11/20; B22D 11/10; B22D 2/00; B22D 11/16; B22C 19/00

(52) U.S. Cl. ..... 164/454; 164/151.4; 164/440; 164/154.7

(58) Field of Search ..... 164/454, 154.7, 164/151.4, 440, 154.6; 374/124; 75/380

(56) References Cited

U.S. PATENT DOCUMENTS 4,109,508 A * 8/1978 Fukuyama ..... 374/124
4,408,903 A * 10/1983 Baldasarri ..... 374/121
4,502,793 A * 3/1985 Smith et al. ..... 374/124
4,588,020 A * 5/1986 Waltl et al. ..... 164/454
4,614,567 A * 9/1986 Stahlherm et al. ..... 201/1
5,267,604 A * 12/1993 Kuttner et al. ..... 164/413
5,673,746 A * 10/1997 Chun et al. ..... 164/454
6,056,041 A * 5/2000 Caron et al. ..... 164/154.7

* cited by examiner

*Primary Examiner*—M. Alexandra Elve
*Assistant Examiner*—Kevin McHenry
(74) *Attorney, Agent, or Firm*—Kenyon & Kenyon

(57) ABSTRACT

In the operation of a horizontal strip casting facility, each lengthwise segment of a metal strip is continuously scanned in a fan shape across the entire width of the metal strip, immediately after emerging from a mold associated with a furnace. An infrared scanner is used to perform the scan, and passes temperature values, taking into consideration the emissivity values corresponding to the material being cast, to a computer. In the computer, on the basis of those temperature values, a color-graded graphic diagram and/or a temperature profile diagram depicting the temperature over the width of the metal strip are created and displayed on at least one monitor. The speed of the metal strip, the volumes of cooling water for the mold, the withdrawal parameters, and the melt temperature in the furnace are controlled as a function of the temperature profile that is ascertained. For this purpose, the computer is coupled to a stored-program control system which in turn is connected to a withdrawal unit and to a curling unit for coiling the metal strip.

5 Claims, 4 Drawing Sheets

METHOD FOR OPERATING A HORIZONTAL STRIP CASTING FACILITY AND APPARATUS FOR CARRYING OUT THE METHOD

BACKGROUND OF THE INVENTION

The invention relates to a method for the production-optimized operation of a horizontal strip casting facility, and a horizontal strip casting facility for carrying out the method.

A conventional horizontal strip casting facility for producing a metal strip to be wound into a coil comprises a furnace (holding furnace or hot-top), onto the exit opening of which is flanged a cooled mold whose mold outlet determines the cross section of the metal strip.

A withdrawal unit is arranged at a distance from the mold. The metal strip is guided in a horizontal direction through the withdrawal unit between several horizontally extending withdrawal rollers.

From the withdrawal unit, the metal strip is guided further in a horizontal plane to a curling unit. The curling unit is equipped with several coiling rollers which bend the metal strip so that after emerging from the curling unit it curls up into a coil.

Located between the withdrawal unit and the curling unit, usually in the vicinity of the withdrawal unit, is a strip cutting unit that is displace able in roller-supported fashion in the longitudinal direction of the metal strip, and cuts through the metal strip when a coil has reached its predetermined diameter.

If necessary, a milling unit for machining the surface of the metal strip can also be integrated between the withdrawal unit and the curling unit.

The movements of the withdrawal rollers of the withdrawal unit, the strip cutting unit, and the coiling rollers of the curling unit are generally coupled to one another via a stored-program control system or via the cast metal strip.

In order to ascertain the temperature status and thereby the quality of a metal strip leaving the mold, it is known to measure the temperature of the metal strip directly after the mold, continuously or from time to time, by way of a contact pyrometer, optical pyrometer, or infrared beams. This measurement is only single-point, however, and is performed predominantly in the center of the metal strip. From these temperature values, usually displayed in digital or analog fashion, conclusions are then drawn as to the temperature status of the entire metal strip. A measurement of this kind thus allows only rough conclusions as to the general temperature level of the cast metal strip. Short-term local temperature anomalies can therefore not be detected in most cases. Such anomalies result, however, in melt perforations with resulting severe damage to the horizontal strip casting facility, or holes or cracks in the metal strip, or other strip defects. The known method thus provides no information as to the temperature distribution over the entire width of the metal strip. Holes or cracks in the metal strip can consequently also be detected only by chance. Using the known methods it is moreover not possible to ensure that the coils which are ultimately wound are of suitable quality. Deficiencies in the quality of the products produced from the coils cannot be ruled out.

SUMMARY OF THE INVENTION

Improving upon known approaches, it is the object of the invention to provide a method for production-optimized operation of a horizontal strip casting facility, and a horizontal strip casting facility for carrying out the method. The invention ensures that the operator of the horizontal strip casting facility is informed, at every point in time during casting, of the surface temperature profile, and thus the condition, of the metal strip.

The invention teaches a method for optimizing the operation of a horizontal strip casting facility for producing metal strip in which metal strip is withdrawn from a watercooled mold that is adjacent a temperature-controlled furnace. The metal strip that emerges from the mold is continuously scanned in a fan shape across the width of the strip with an infrared scanner that is spaced from the strip immediately after the strip emerges from the mold, so as to determine the temperature profile of the strip. These temperature values are passed to a computer, where they are processed and, along with emissivity values corresponding to the material being cast, are used to generate a graphical representation of the temperature profile that is displayed to the operator on a monitor. This profile information is used to control a number of parameters relating to the operation of the facility, including the speed of the metal strip, the quantity of cooling water that is fed to the mold, withdrawal parameters, and the melt temperature in the furnace.

According to a further aspect of the invention, when the temperature goes above or below predefined upper or lower temperature limit values, the computer triggers an alarm or brings about a shutdown of the horizontal strip casting facility.

A primary aspect of the invention is the positioning of an infrared scanner, operating in noncontact fashion, directly at the mold outlet. Because the temperature measurement head of the infrared scanner is movable, the entire width of the metal strip can be scanned in a fan shape. Scanning is preferably accomplished up to approximately ten times per second. The temperature values ascertained by the infrared scanner are then conveyed to a computer, taking into account the emissivity values corresponding to the material being cast. On the basis of the temperature values, the computer then creates either a color-graded graphic diagram or a temperature profile diagram depicting the temperature over the width of the metal strip. These diagrams can then be selectably displayed on a monitor, in succession or next to one another, or even on two separate monitors. Based on the curves in the diagrams, the operator of the horizontal strip casting facility immediately recognizes critical situations and can therefore also immediately react and make appropriate adjustments.

A particular advantage of this approach is that because the instantaneous temperature profile is known, the horizontal strip casting facility can always be operated with the maximum possible production output. In other words, the strip speed, volumes of cooling water to the mold, withdrawal parameters, and melt temperature can each be specifically controlled.

In this context, a very important advantage of the invention lies in its ability to accurately depict to the operator the relative state of the solidification zone, which hitherto was not provided to the operator.

Since the computer is capable of detecting temperature anomalies over the entire width of the metal strip, a further advantage in the context of the invention is the fact that if the temperature goes above or below predefined upper and lower limit values, the computer can trigger an alarm or even bring about a shutdown of the horizontal strip casting facility. For this purpose, the computer is coupled to the withdrawal unit via a stored-program control system.

If an excessively high temperature is detected, for example, the computer can trigger an alarm with delayed shutdown, so that the operator can in any case still react and take suitable measures to normalize the temperature. If, however, the computer detects a considerable decrease in temperature or even a breakage, it shuts down the entire horizontal strip casting facility. A more serious production malfunction can thereby be prevented.

It is also within the scope of the invention to analyze the causes of temperature fluctuations at a later point in time, since the computer stores all the data and consequently provides documentation that can be examined later.

BRIEF DESCRIPTION OF THE FIGURES

The invention is explained in more detail below with reference to the embodiments depicted in the drawings, in which.

DETAILED DESCRIPTION

Figure 1:
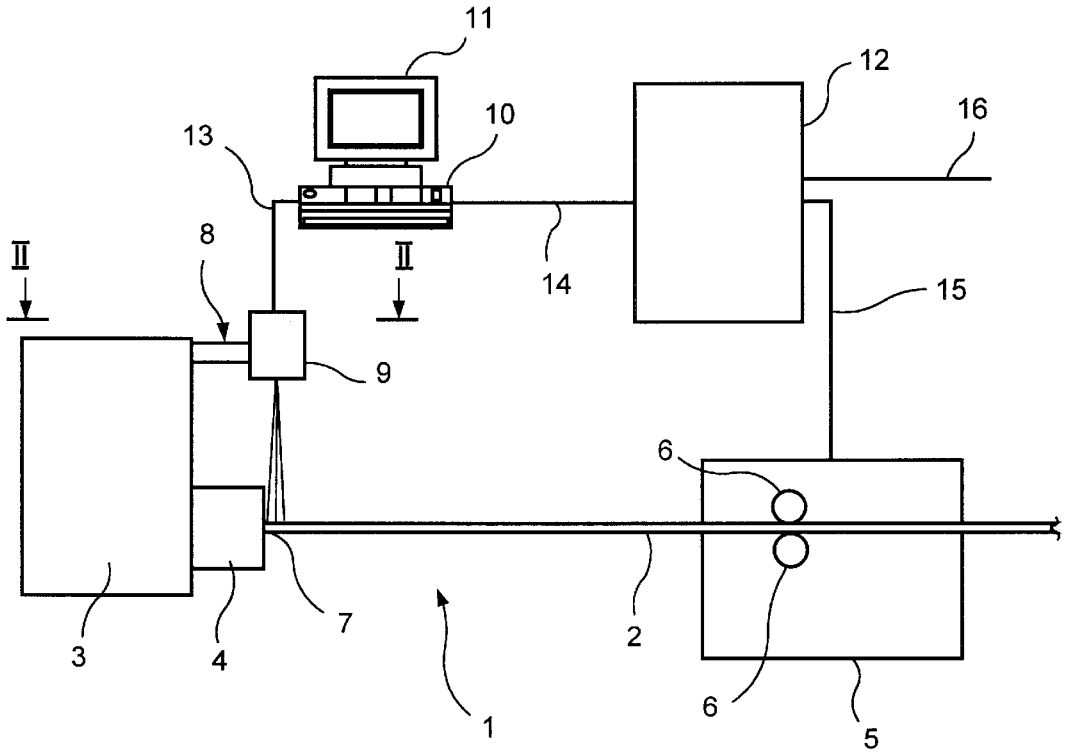
FIG. 1 schematically shows a horizontal strip casting facility constructed according to the principles of the invention.

Reference numeral 1 in FIG. 1 denotes a horizontal strip casting facility for manufacturing a metal strip 2 that is made of a copper alloy (in the particular embodiment illustrated) and which has a flat rectangular cross section.

Horizontal strip casting facility 1 includes a holding furnace 3, a cooled mold 4 flanged onto the latter, a withdrawal unit 5 with withdrawal rollers 6, and a curling unit (not shown) where metal strip 2 is wound into a coil.

Figure 2:
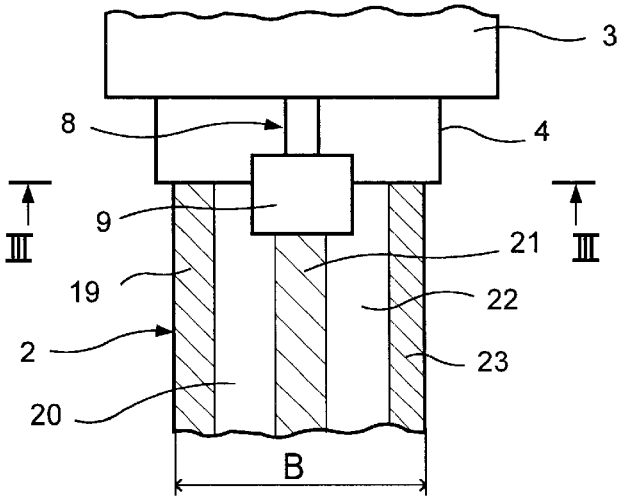
FIG. 2 shows a horizontal longitudinal section taken through the depiction of FIG. 1, along line II—II.
Figure 3:
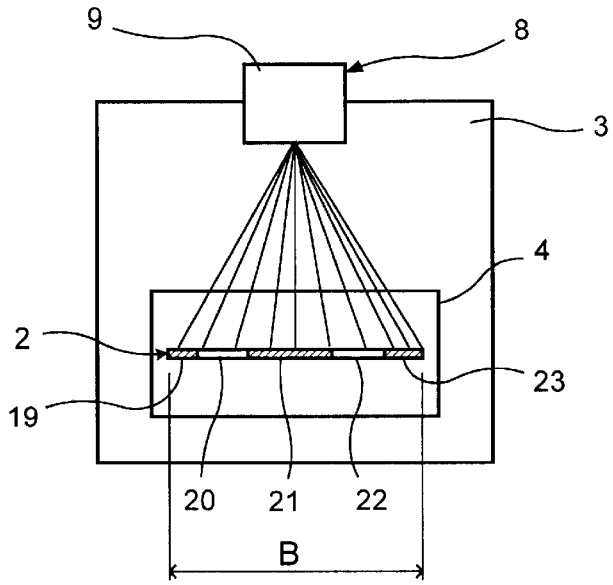
FIG. 3 shows a vertical section through the depiction of FIG. 2, taken along line III—III.

An infrared scanner 8 having a movable temperature measurement head 9 that scans the entire width B of metal strip 2 is positioned at a defined distance directly next to mold outlet 7 above metal strip 2 (see also FIGS. 2 and 3). Temperature measurement head 9 scans the entire width B of metal strip 2 in a fan shape (FIG. 3).

As is further evident from FIG. 1, infrared scanner 8 is coupled via a line 13 to a computer 10 with associated monitor 11. Computer 10 is in turn connected via a line 14 to a stored-program control system 12 that for its part is connected via a line 15 to the drive system (not depicted in further detail) of withdrawal rollers 6 of withdrawal unit 5. Stored-program control system 12 is moreover coupled via a line 16, in a manner not otherwise depicted in further detail, to the curling unit.

Figure 4:
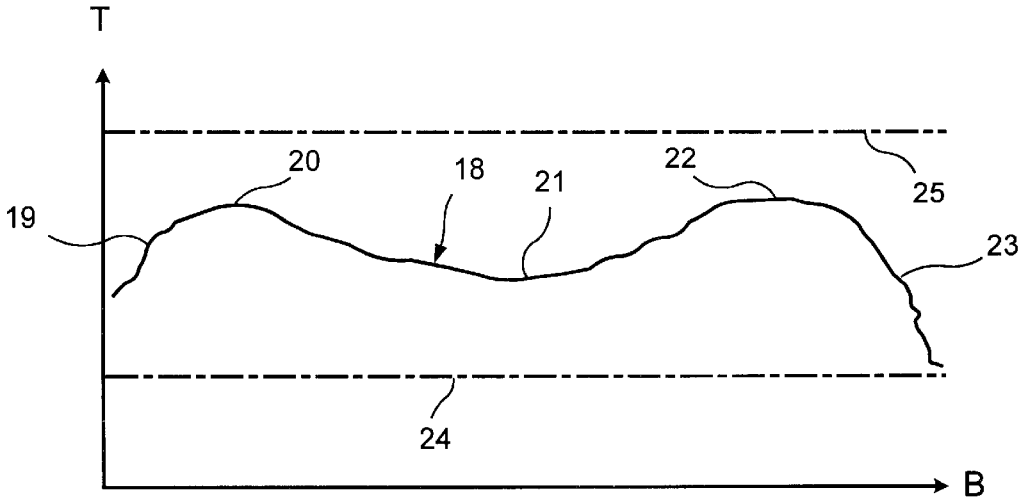
FIG. 4 shows an instantaneous temperature profile diagram of a metal strip at normal temperature.

Each lengthwise segment of metal strip 2 is scanned by infrared scanner 8, in the fan-shaped manner evident in particular from FIGS. 1 and 3, immediately after emerging from mold 4. Scanning is accomplished at a frequency of 10 pulses per second. Infrared scanner 8 then passes the temperature values of metal strip 2, ascertained in consideration of the emissivity values corresponding to the material being cast, to computer 10. The latter then displays on monitor 11 either a color-graded graphic diagram or, as shown in FIG. 4, a temperature profile 18 depicting temperature T over width B of metal strip 2. In normal circumstances, for example in the case of a standardized temperature profile for tin bronze, the profile that results is one of the sort shown in FIG. 4, the individual curve segments 19–23 of which are identified in FIGS. 2 and 3 with reference to metal strip 2 by different band patterning.

The diagram in FIG. 4 additionally illustrates the permissible minimum temperature value by way of a dot-dash line 24, and the maximum temperature value by way of a dot-dash line 25.

Figure 5:
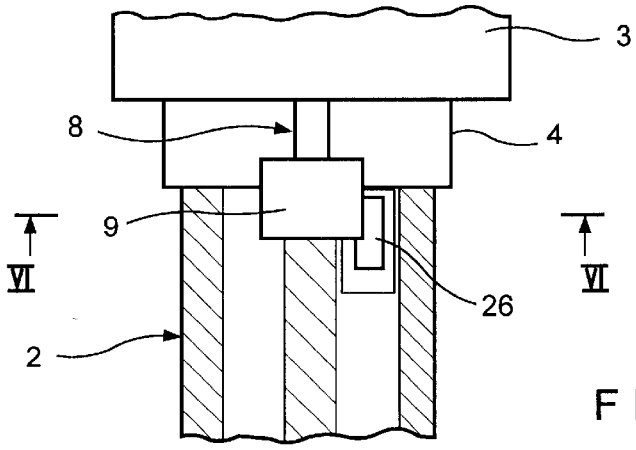
FIG. 5 shows the depiction of FIG. 2, for the case of a locally elevated strip temperature.
Figure 6:
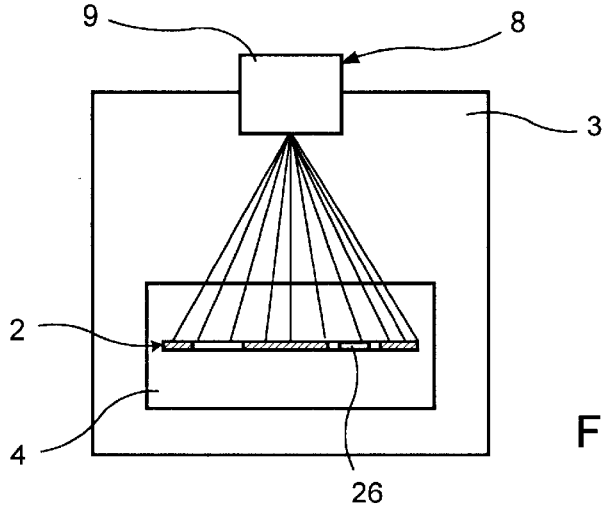
FIG. 6 shows a vertical cross section through the depiction of FIG. 5, along line VI—VI.
Figure 7:
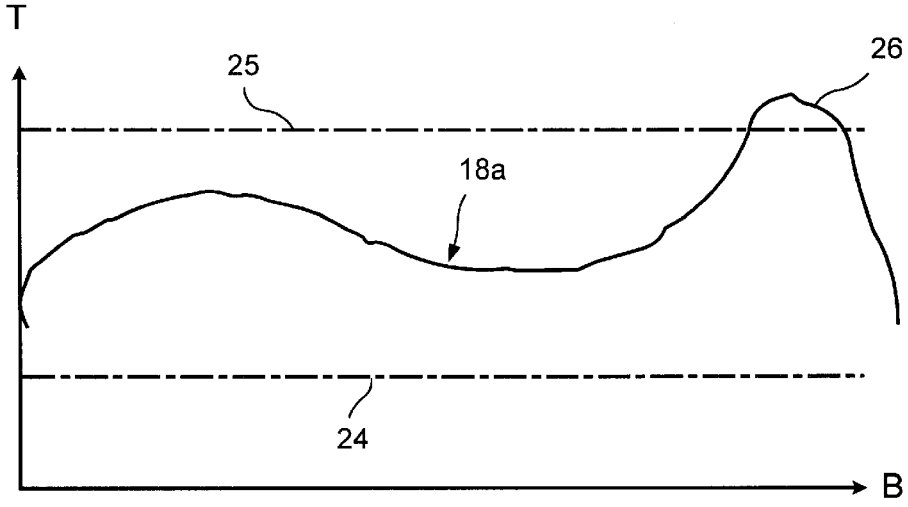
FIG. 7 shows an instantaneous temperature profile diagram for the case of a locally elevated temperature.

FIGS. 5 through 7 illustrate a production situation in which infrared scanner 8 detects, and displays on monitor 11, a lateral region 26 on metal strip 2 having an elevated temperature that is above the permissible maximum temperature value defined by line 25. The operator can then recognize this situation on monitor 11 by way of temperature profile 18*a*, and initiate suitable countermeasures in a controlled fashion.

Figure 8:
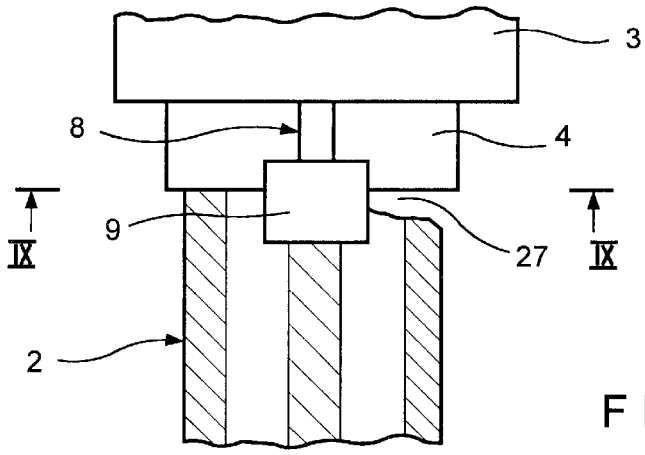
FIG. 8 shows a depiction corresponding to that of FIG. 2, for the case of a strip breakage.
Figure 9:
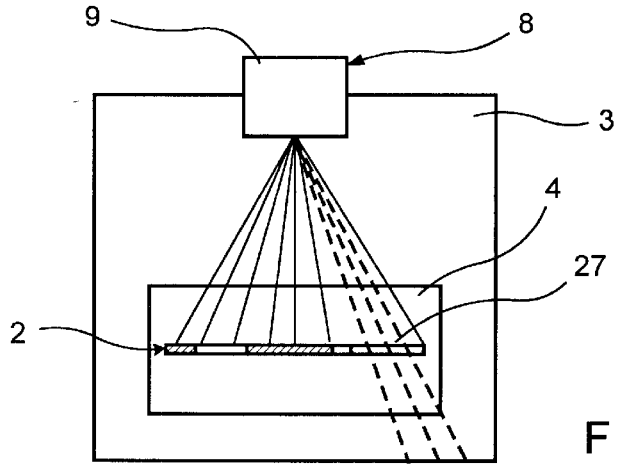
FIG. 9 shows a vertical cross section through the depiction of FIG. 8, along line IX—IX.
Figure 10:
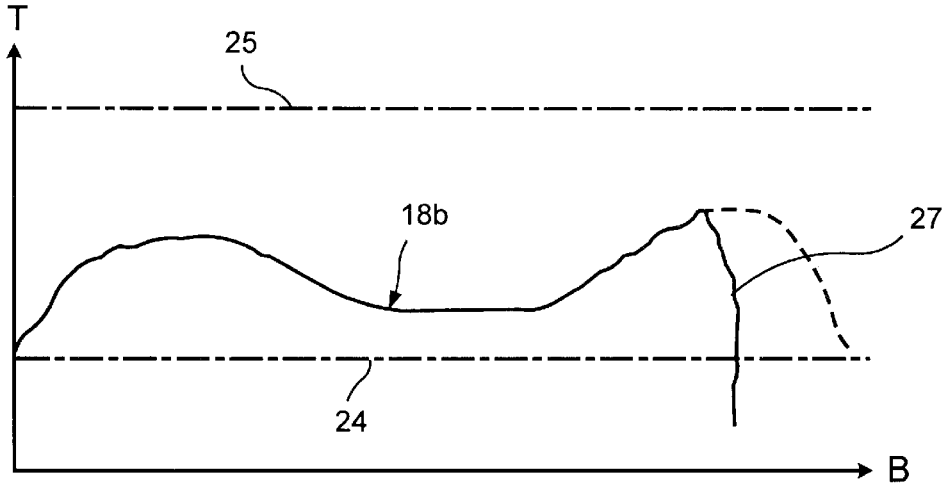
FIG. 10 shows an instantaneous temperature profile diagram for the case of a strip breakage.

FIGS. 8 through 10 show a production situation in which metal strip 2 has broken off in region 27. Infrared scanner 8 perceives no thermal radiation there, thus displaying on monitor 11 (FIG. 10) a temperature profile 18*b* in which the temperature has fallen below the minimum limit value in accordance with line 24, and an alarm is triggered with immediate shutdown of the entire horizontal strip casting facility 1.

What is claimed is:

1. A method for optimizing the operation of a horizontal strip casting facility for producing metal strip in which metal strip is withdrawn from a water-cooled mold that is adjacent a temperature-controlled furnace, comprising the steps of:

continuously scanning each lengthwise segment of metal strip in a fan shape across the entire width of the strip with an infrared scanner that moves in a fan-shaped pattern, the scanner is spaced from the strip immediately after the strip emerges from the mold, so as to determine the temperature profile of the strip;

passing the temperature values ascertained by scanning to a computer;

processing the temperature values in conjunction with emissivity values corresponding to the material being cast in the computer in which, on the basis of those temperature values, a color-graded graphic diagram and/or a temperature profile diagram that depicts the temperature over the width of the metal strip is created and displayed on at least one monitor; and controlling the speed of the metal strip, the quantity of cooling water that is fed to the mold, withdrawal parameters, and the melt temperature in the furnace as a function of the temperature profile so obtained.

2. The method as defined in claim 1, in which when the temperature goes above or below predefined upper and lower temperature limit values, the computer triggers an alarm or brings about a shutdown of the horizontal strip casting facility.

3. A horizontal strip casting facility, comprising:

a furnace;

a cooled mold having a mold outlet;

a withdrawal unit located at a horizontal distance from the mold for withdrawing the metal strip from the mold and furnace;

an infrared scanner that has a movable temperature measurement head adjacent the mold outlet and spaced above the strip so that the head does not physically contact the strip, wherein the scanner is configured to scan the entire width of the strip through a movement of the scanner so as to determine the temperature profile of the strip;

a computer, to which the scanner is connected;

at least one monitor connected to the computer; and a stored-program control system associated with the computer that governs the operation of the withdrawal unit as a function of the temperature profile so obtained.

4. The method as defined in claim 2, in which the shutdown is delayed so as to allow an operator to take measures to normalize the temperature.

5. The method as defined in claim 1, in which scanning is accomplished at a frequency of approximately ten pulses per second.

* * * * *